United States Patent [19]

Jeanrot

[11] Patent Number: 4,746,119

[45] Date of Patent: May 24, 1988

[54] BALL-GAME RACKET WITH FOLDABLE AND SEPARABLE FRAME OR BODY

[76] Inventor: Patrick Jeanrot, 51, Avenue Lucien Barraut, 94500 Champigny S/Marne, France

[21] Appl. No.: 910,396

[22] PCT Filed: Jan. 24, 1986

[86] PCT No.: PCT/FR86/00024

§ 371 Date: Sep. 22, 1986

§ 102(e) Date: Sep. 22, 1986

[87] PCT Pub. No.: WO86/04251

PCT Pub. Date: Jul. 31, 1986

[30] Foreign Application Priority Data

Jan. 24, 1985 [FR] France ..... 85 01018
May 30, 1985 [FR] France ..... 85 08117

[51] Int. Cl.[4] ..... A63B 49/02

[52] U.S. Cl. ..... 273/73 C; 273/73 J; 273/73 G

[58] Field of Search ..... 273/73 R, 73 C, 73 D, 273/73 E, 73 F, 73 G, 73 H, 73 J, 75, 29 A, 26 B, 193 B, 67 R

[56] References Cited

U.S. PATENT DOCUMENTS

| | | | |
|---|---|---|---|
| 1,673,614 | 6/1928 | Boening | 273/73 C |
| 2,159,579 | 5/1939 | Whitney | 273/193 B |
| 3,679,205 | 7/1972 | Finkle et al. | 273/193 B |
| 4,367,871 | 1/1983 | Schiefer | 273/29 A |
| 4,609,198 | 9/1986 | Torr | 273/73 J |

FOREIGN PATENT DOCUMENTS

| | | | |
|---|---|---|---|
| 886136 | 6/1943 | France | 273/73 G |
| 1423709 | 11/1965 | France | 273/73 R |
| 1489007 | 6/1967 | France | 273/73 C |
| 3204 | of 1881 | United Kingdom | 273/73 C |
| 12753 | of 1886 | United Kingdom | 273/73 C |
| 11893 | of 1902 | United Kingdom | 273/73 J |

*Primary Examiner*—Richard C. Pinkham
*Assistant Examiner*—Matthew L. Schneider
*Attorney, Agent, or Firm*—Arthur B. Colvin

[57] ABSTRACT

A racket for ball games is comprised of a handle and a head. The head and handle are pivotably connected so as to be foldable by an Omega shaped pivot pin having a pair of longitudinally offset pivot axes. Vibration dampening material is disposed between the handle and head and provision is made for locking the handle and head in playing position.

2 Claims, 7 Drawing Sheets

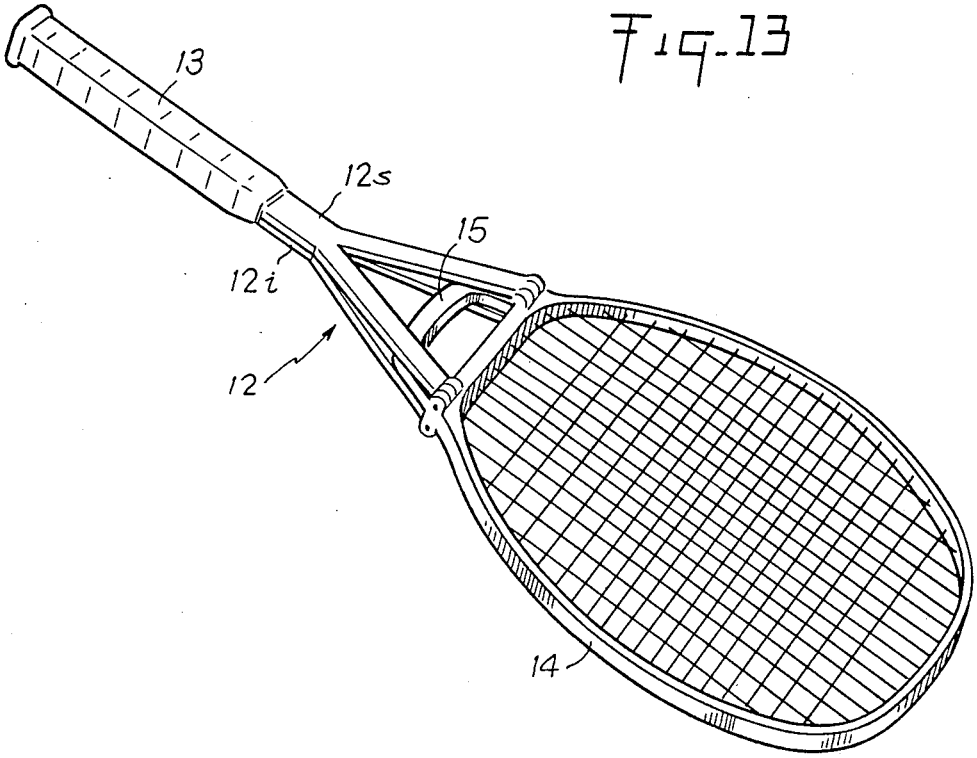
Fig. 13
Fig. 14
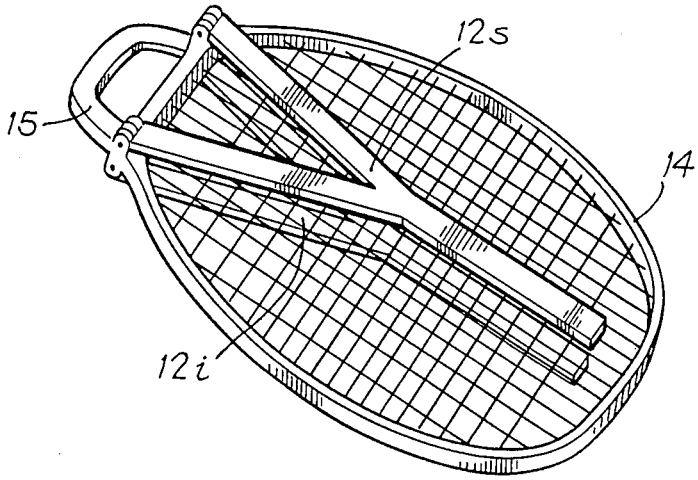

Fig. 15
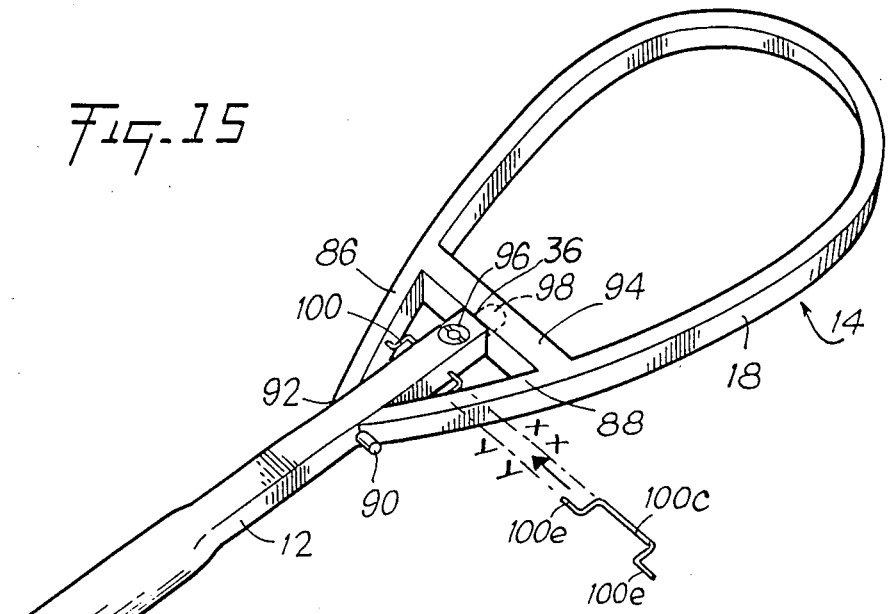
Fig 16a
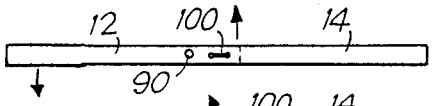
Fig 16b
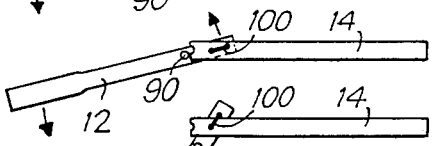
Fig 16c
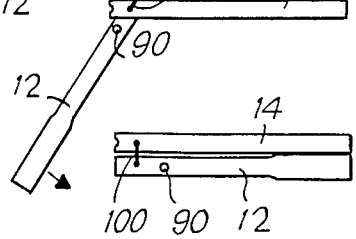
Fig 16d
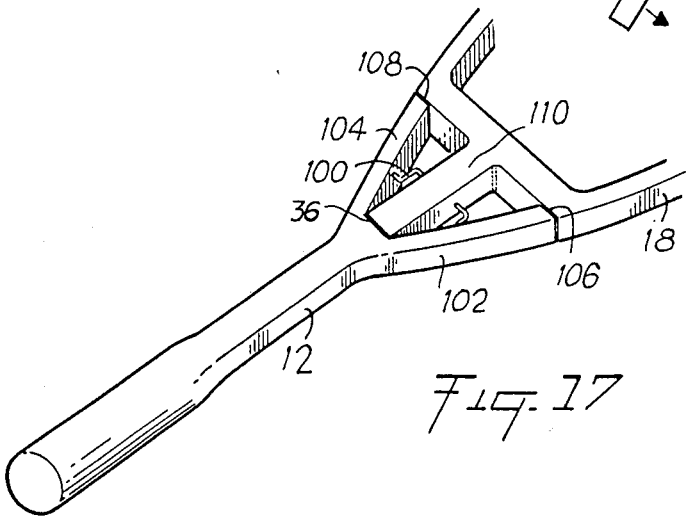
Fig. 17

BALL-GAME RACKET WITH FOLDABLE AND SEPARABLE FRAME OR BODY

The present invention relates to a racquet for ball games, having a folding and separable frame.

All one-piece racquets present a certain number of drawbacks. They are bulky for players having to travel with their racquets. It is difficult to stow a racquet away in a bag, the handle often projects out. The covers provided for storing them often envelop only the head, leaving the handle to project.

Furthermore, the heads exist in many different sizes and shapes, which makes it necessary, in order to try them out, to acquire several racquets. Moreover, the grip which surrounds the handle must be changed several times during a match for optimum efficiency. Similarly, the stringing of the head may need to be changed during a match, either because it has deteriorated or because the opponent's game necessitates different tactics; stringing for an attacking game being under greater tension than stringing for a defensive game. In addition, the vibrations produced by the shock of the ball on the head are transferred directly to the handle then to the player's arm.

THE PRIOR ART

Racquets are known, of which the handle may be folded down onto the head, as illustrated for example in French Pat. No. 1 423 709 or U.S. Pat. No. 1,673,614.

However, these are very rudimentary solutions which have not been developed in practice, mainly because the problem of blocking the hinge between the handle and the head has not been satisfactorily solved.

SUMMARY OF THE INVENTION

It is an object of the present invention to overcome these drawbacks and to bring various advantages, by proposing a racquet for ball games, formed by a handle and a head or the like, pivotally mounted with respect to each other about a pin, forming hinge, characterized in that it comprises a device for blocking said hinge, located remote from the pivot pin, as well as a vibration damping device interposed between said handle and said head.

Thanks to the invention, the handle folds down onto the head, or vice versa, this enabling it to be easily stowed away in a cover provided to this end, having the form of a head and being sufficiently wide in order possibly to contain several heads and several handles.

It also becomes possible to separate head and handle, by providing a dismountable hinge. This gives the possibility of adapting any size of head to any size of handle, and vice versa. It also becomes possible for a child to play with the head intended for an adult, by fitting his handle thereon, and for the same player to have several heads of different sizes or different shapes, or with different string tensions, as well as several handles with different grips ready for use at any moment. Anatomical handles, i.e. handles having the form of the player's hand, may be produced independently of the head. The head and the handle therefore become two separate parts, connected together by their hinge, separated by damping joints where, the hinge itself performing the role of damper, the vibrations are no longer transferred to the player's arm, thus reducing the problems of tennis elbow for the player.

From the racquet manufacturers' point of view, it will be observed that, as the handle and head are two distinct elements, they may be manufactured in accordance with different technologies, each element being smaller and lighter than the elements of a one-piece racquet, this making it possible to simplify production tools. Manufacturing defects will not involve rejection of a whole racquet but only of the element, handle or head, concerned. Finally, packing for transport, delivery and presentation may be simplified, and may lead to novel original forms.

BRIEF DESCRIPTION OF THE DRAWINGS

The invention will be more readily understood on reading the following description with reference to the accompanying drawings, in which:

FIGS. 13 and 14 illustrate a variant racquet with handle hinged by half.

FIGS. 15 and 16 illustrate a hinged racquet with offset hinge.

FIG. 17 illustrates a variant racquet similar to that of FIG. 15.

DETAILED DESCRIPTION OF THE DRAWINGS

Figure 1:
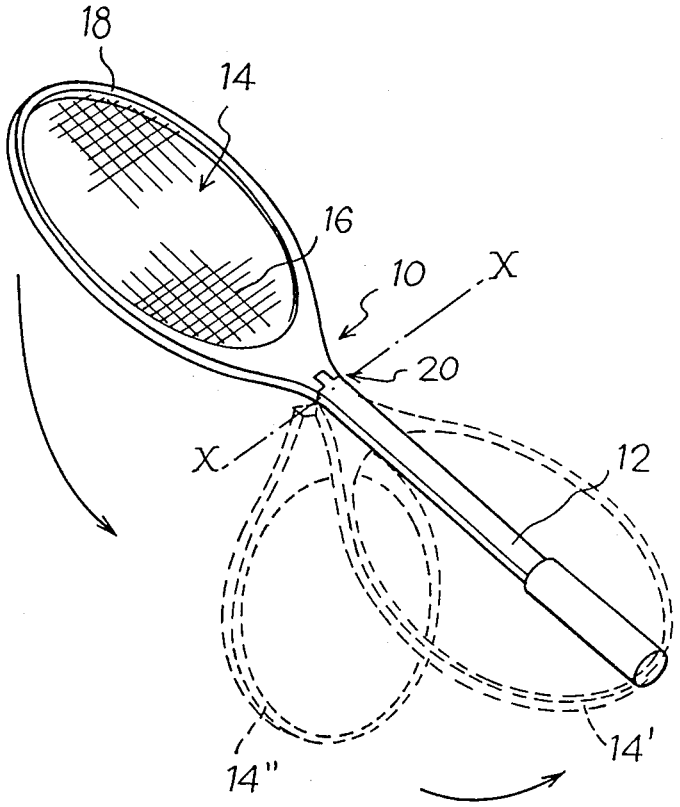
FIG. 1 is a schematic view illustrating a racquet according to the invention, in three different arrangements.

Referring now to the drawings, the racquet 10 illustrated in FIG. 1 is a tennis racquet, but it will be understood that the present invention is applicable to any racquet for playing ball games in general, or for games where a racquet is used for striking an object.

Racquet 10 comprises a handle 12 and a head 14 formed by strings 16 stretched over a frame 18. In accordance with the invention, the handle and the head are two separate components, assembled by means of a hinge 20, so that the head may be brought in line with the handle into normal position of use (shown in solid lines) or folded against the handle in stowed away position (dashed lines 14'), by pivoting about axis XX of the hinge 20 (dashed lines 14'').

This type of assembly offers the user and manufacturer the numerous advantages which have already been set forth hereinabove and which will therefore not be repeated here.

The hinge may be constituted in various ways, as will be seen in the following specification. The most simple embodiment consists in laterally fixing a flat hinge, which will preferably be dismountable, which enables the handle to be separated from the head.

Figure 2:
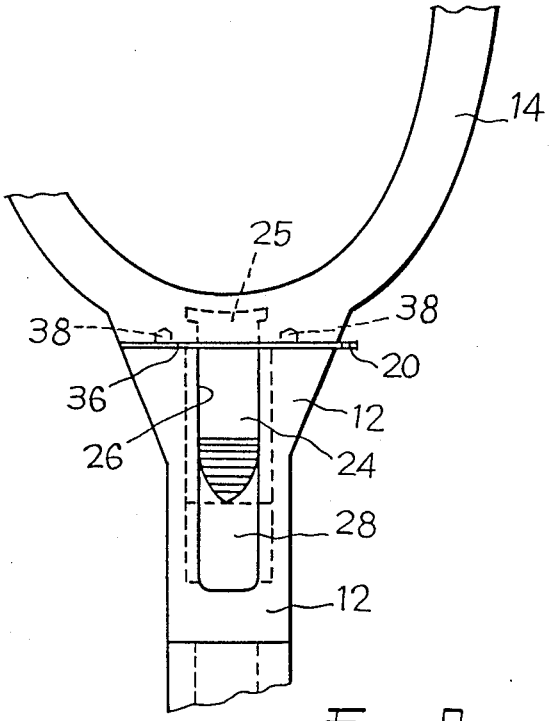
FIGS. 2 and 3 illustrate a first embodiment of the hinge between the handle and the head with blockage by catch bolt.
Figure 3:
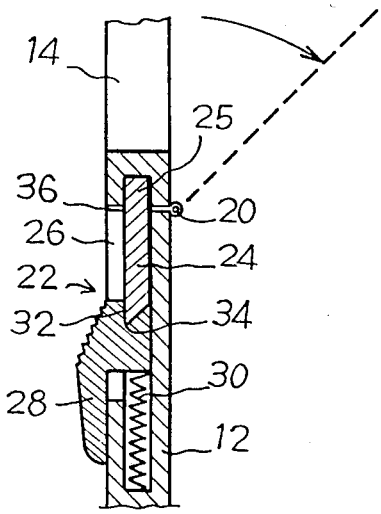

FIGS. 2 and 3 illustrate a device 22 for blocking the hinge 20, seen in plan view in FIG. 2 and in section in FIG. 3.

The hinge is of the flat type and enables the head 14 to pivot towards the right, considering FIG. 3.

Head 14 bears a rod 24 whose head 25 is embedded in the frame 18 and which projects towards handle 12.

Handle 12 comprises a cut-out 26 in which is housed rod 24 in the aligned position illustrated in the Figures. At the bottom of the cut-out is housed a sliding latch 28 guided in the cut-out in the manner of a slide and pushed in the direction of the hinge by a spring 30.

The end of the latch comprises a re-entrant shoulder 32 beneath which is engaged the nose 34 of the rod, which locks the head in line with the handle.

To fold the head down along the handle, it suffices to push latch 28 downwardly against the spring until the nose 34 escapes the latch.

Between the handle and the head, at the level of the hinge, there is interposed a plate 36 made of vibration-damping material, intended to prevent propagation of the vibrations from the head towards the handle, this avoiding physiological problems for the user of the racquet. The handle also bears positioning lugs 38 which will advantageously likewise be made of vibration-damping material. Moreover, the cut-out 26 may be lined with vibration damping material in order to avoid transmission of vibrations via rod 24.

Figure 4:
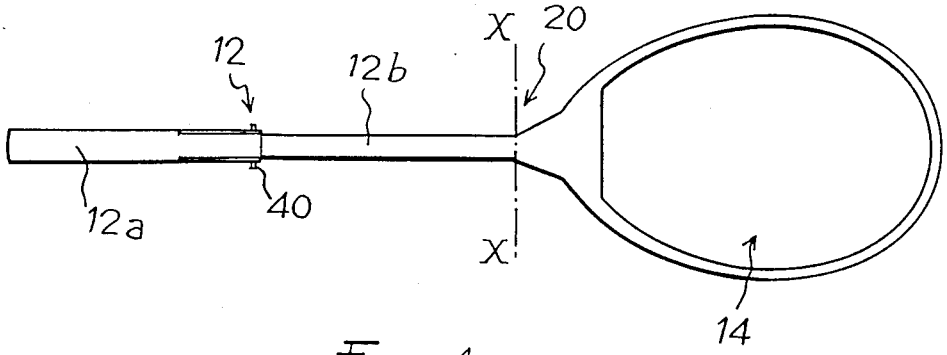
FIG. 4 shows a telescopic racquet handle.

If the handle is particularly long, as is the case for squash racquets, for example, the handle risks projecting beyond the head once it has been folded down. As illustrated in FIG. 4, a sleeve may in that case be provided, composed of two parts 12*a* and 12*b* mounted telescopically with respect to each other, with a pawl-type blocking device 40.

Figure 5:
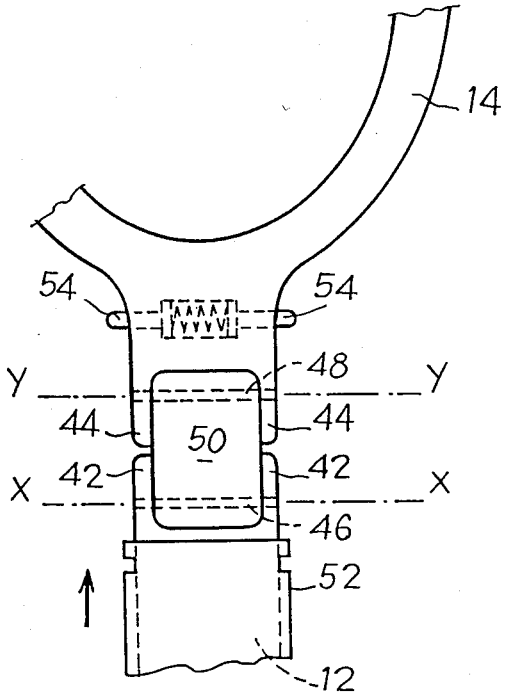
FIGS. 5 and 6 illustrate a second embodiment of the hinge between the handle and the head with blockage by sliding bush.
Figure 6:
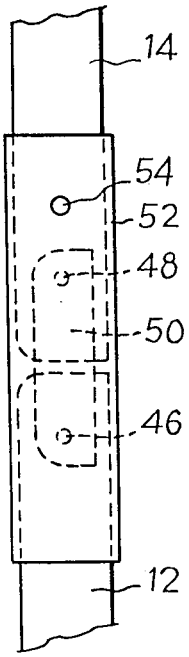

FIGS. 5 and 6 illustrate a variant hinge with two axes XX, YY, making it possible to house the pivot pins substantially at the centre of the thickness of the handle and the head. In fact, in the solutions set forth hereinbefore employing a simple hinge, the pivot pin is necessarily located on the surface, in order to allow the handle to be folded down "flat" against the head.

As illustrated, handle 12 and head 14 terminate, at their opposite ends, in lugs 42 and 44 respectively, between which is fitted an intermediate plate 50 with two pivots 46 and 48, the first passing through lugs 42 of the handle and the second lugs 44 of the head, substantially at the centre of the thickness of the handle and head. The longitudinal spacing between the axes (XX, YY) of the two pivots 46 and 48 is calculated so as to allow the head to be folded down "flat" against the handle by rotation of the head through about 90° with respect to intermediate plate 50 and of the latter through about 90° with respect to the handle.

At least one of the pivots may be disassembled in order to separate the handle from the head.

The head and intermediate plate are blocked in line with the handle by means of a bush 52 sliding along the handle, which covers the ends of the handle and head on either side of the intermediate plate (FIG. 6).

The blocking bush is maintained in position by means of a pawl device 54 similar to that of the telescopic handle of FIG. 4.

In this embodiment, the transmission of vibrations from the head to the handle is avoided by making the intermediate plate itself from a vibration-damping material.

Figure 7:
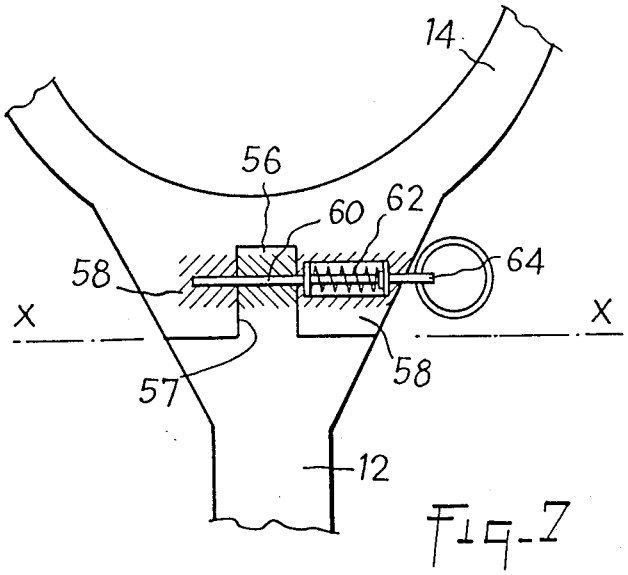
FIG. 7 illustrates a hinge blocking element constituted by a pin.

FIG. 7 shows a hinge blocking device employing a pin. To simplify the Figure the hinge of axis YY has not been shown.

The handle 12 extends in a male tenon 56 which is housed in a female notch 57 between two wings 58 of the head. One of these wings bears a pin shank 60 loaded by a spring 62 and terminating outside by a manoeuvring ring 64. The pin shank passes through tenon 56 of the handle and the two wings 58 of the head to ensure reliable, positive blocking of the head and handle in line with each other.

There again, although this has not been shown in the Figure a blade of vibration-damping material is interposed between handle and head at the level of the hinge.

Figure 8:
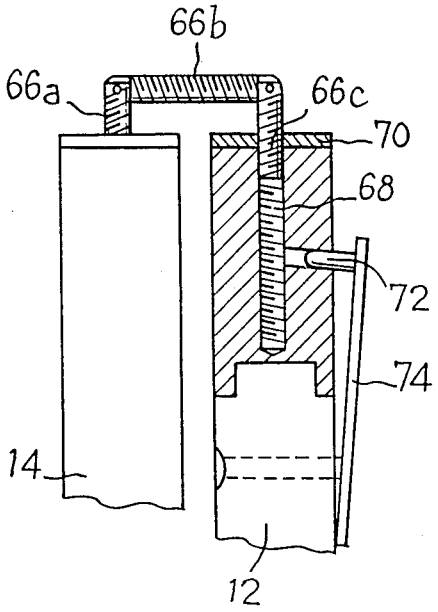
FIGS. 8 and 9 illustrate a device with retractable double hinge.
Figure 10:
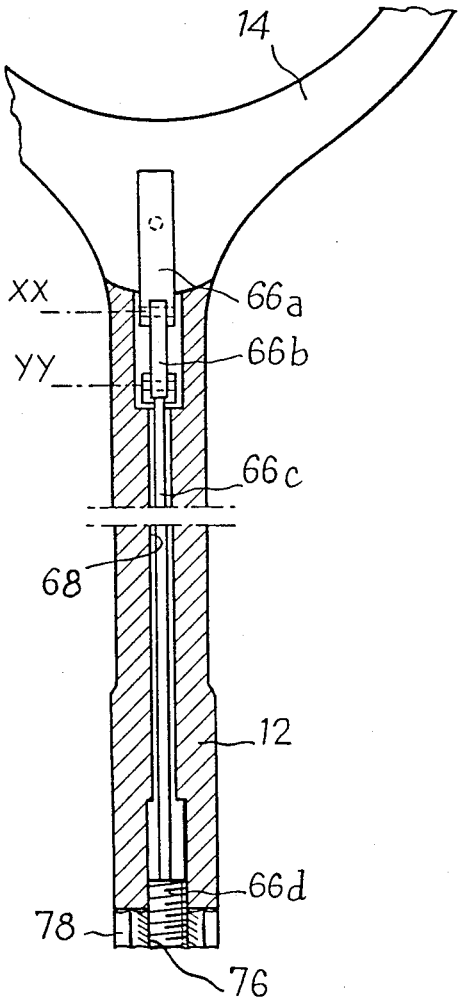
FIG. 10 illustrates a variant embodiment of the device with retractable double hinge.
Figure 9:
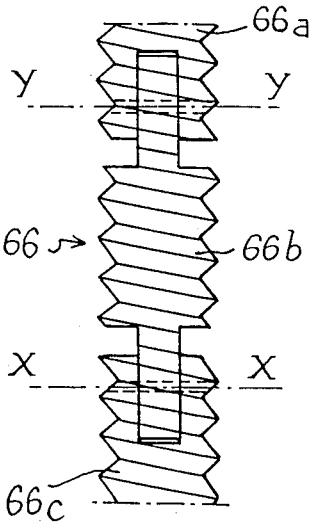
Figure 11:
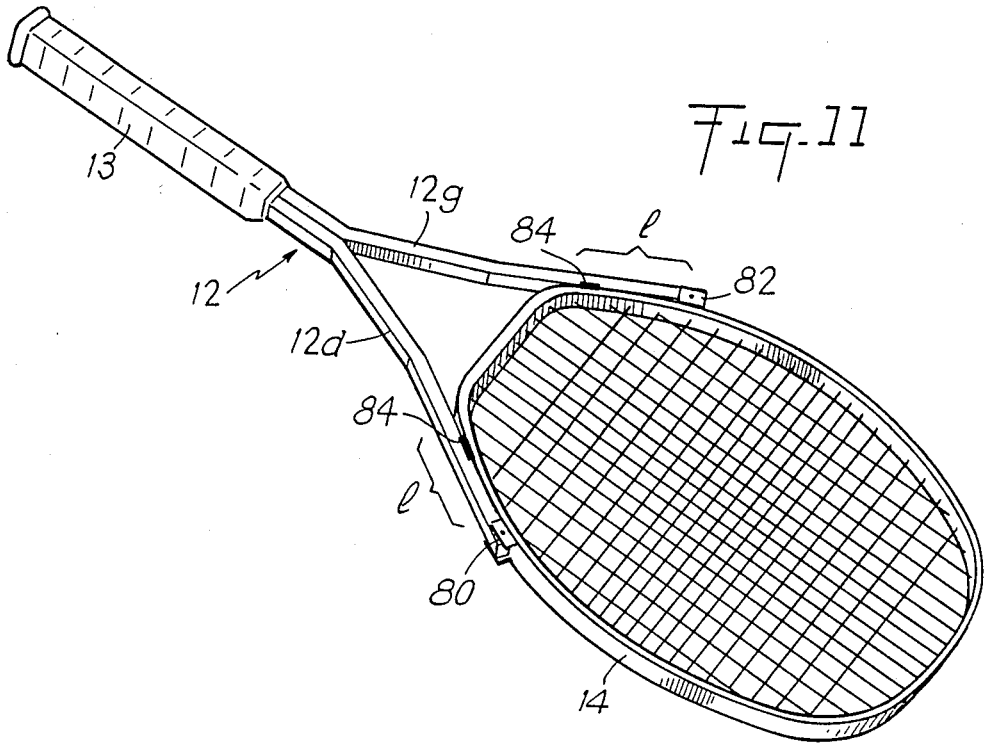
FIGS. 11 and 12 illustrate a racquet with a handle hinged by half.
Figure 12:
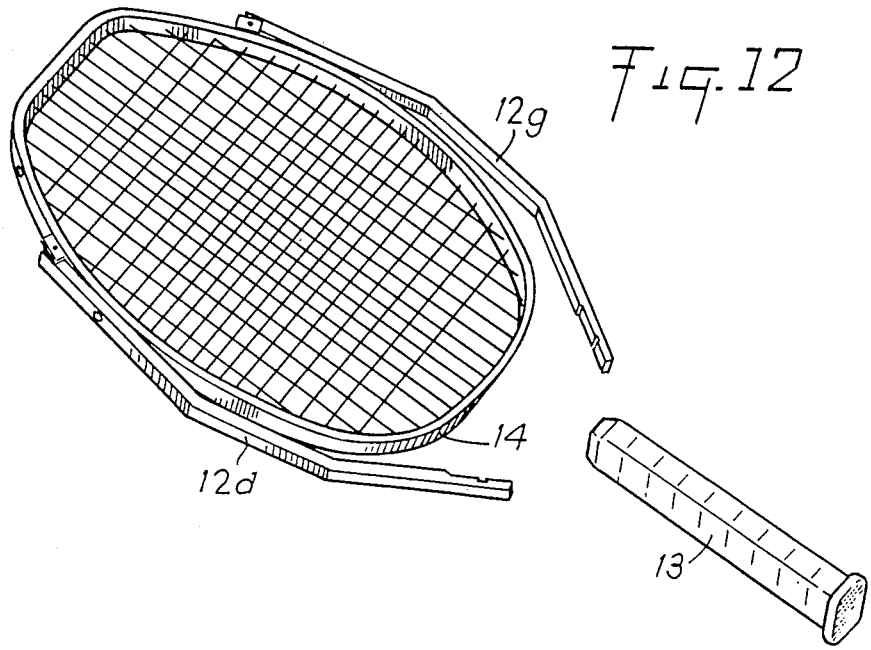

FIGS. 8, 9 and 10 illustrate two similar variant hinges with two axes, in which the whole of the hinge device is retractable in the handle.

In these two variant embodiments, the hinge device comprises a composite rod 66 formed by three successive sections 66*a*, 66*b*, 66*c*, the first being fast with head 14 and handle 12 comprising a housing 68 adapted to receive the composite rod assembly. The sections of rod are connected by tenon and lug hinges, of axes XX and YY, respectively, similar to that of the embodiment of FIGS. 5 and 6.

In the first variant, FIGS. 8 and 9, the composite rod is threaded and housing 68 is tapped, with the result that, when the head is brought in line with the handle, the threaded rod is virtually uninterrupted and may be screwed in housing 68 until the head and handle come into tight contact with the interposition of a blade 70 made of vibration-absorbing material. Accidental unscrewing of rod 66 is prevented by means of a catch 72 with spring 74 mounted on handle 12 and which is engaged in a transverse hole in rod section 66*c*.

In the embodiment of FIG. 10, rod 66 is smooth, like housing 68 which passes through the whole of handle 12. The rod terminates in a short threaded portion 66*d* on which is screwed an adjusting nut 76 surrounded by a knurled knob 78.

The two variant embodiments of FIGS. 11–12 and 13–14 present as common feature the fact that the handle is made of two juxtaposed halves adapted to be folded individually down against the head.

In the first case, the handle 12 is constituted by two identical halves 12*g* and 12*d* placed side by side, and maintained clamped with the aid of a removable tubular handle 13. Each handle half is articulated (pivots 80 and 82) on the sides of the frame of the head and may thus fold laterally in the plane of the head itself.

As illustrated, the two handle halves, in unfolded position, are in contact with the head frame over a certain length so as to ensure holding of the head. Over this length, the head frame and the handle halves will preferably have complementary profiles so as to complete efficiency of holding of the head.

The small plates 84 intended for damping the vibrations will be imprisoned between the handle and the head in these zones and the distance between the plates 84 and the pivot pins 80 and 82 may be varied so as to vary the characteristics of damping.

In the second case (FIGS. 13 and 14), the handle 12 is constituted by two identical halves 12*i* and 12*s* superposed and maintained clamped on each other by means of a removable tubular handle 13. Each half is articulated on the base of the frame of the head and may thus fold on each side of the head.

To ensure firm maintenance of the head, the latter comprises an extension 15 inserted between the two handle halves 12*i* and 12*s*.

In both cases, the points of articulation of the handle halves are located in spaced apart relationship with respect to each other in order to obtain a good torsional strength.

In the embodiment illustrated in FIG. 15, the frame 18 of the racquet head 14 is extended by two arms 86, 88 which terminate against the handle 12. The ends of arms 86, 88 are notched and cooperate with stop lugs 90, 92 projecting on the two sides of the handle. Handle 12 extends until it contacts the base 94 of the frame, on which it is fixed by a removable means, for example a cam or eccentric device 96 fixed to the end of the handle and cooperating with a rod with head 98 crimped in the frame.

A pivot pin 100 is mounted between the arms of the frame and the handle and ensures an offset articulation to allow the handle to fold down "flat" against the head.

As illustrated in the detailed view bracketed to the Figure pivot pin 100 is substantially in the form of an omega, and presents a central pivot section 100*c* passing through the handle and defining a first pivot axis XX, and two outer pivot sections 100*e* passing through the arms of the frame and defining a second pivot axis YY.

In this way, when the handle 12 is disconnected from the frame, by release of the cam device 96, the handle may be tipped in order to release the lugs 90, 92 from the end notches in arms 86, 88 in a first phase, then the handle continues to be tipped until it is folded down against head 14.

FIGS. 16*a* to 16*d* schematically illustrate the successive phases of tipping and folding of the handle.

FIG. 16*a:* beginning of tipping

FIG. 16*b:* disengagement of lugs

FIG. 16*c:* folding down underway

FIG. 16*d* folding down terminated.

In order to facilitate understanding, the pin 100 has been shown in solid lines, although it is normally hidden by the elements of the racquet.

In the variant illustrated in FIG. 17, the arrangement of FIG. 15 has been reversed, i.e. the handle terminates in a fork by two arms 102 and 104 which join the frame of the head at two spaced apart points 106 and 108 and the frame comprises a longitudinal extension 110 which joins the handle at the join of the two arms 102 and 104.

This arrangement improves the holding of the handle in torsion with respect to the head.

Of course, there again, the articulation is made by means of a pivot pin 100 with offset axis identical to the one which has just been described in connection with FIG. 15. Removable fixing devices (not shown) are provided at the ends of the arms as well as at the end of the extension.

To terminate this description, it will be mentioned that the elements intended for damping the vibrations, in all the embodiments, may be made to be interchangeable, the racquet being equipped with a set of small plates or other vibration damping elements presenting different characteristics and which the user may choose depending on the desired result. In certain cases, he may use a plurality of elements in order to combine their characteristics.

All the embodiments described present the common advantage that the handles and the heads are mounted with articulation with respect to one another, and that a device for blocking the articulation is provided, located remote from the pivot pin, as well as a vibration damping device interposed between the handle and the head.

Although this has not been described, it will be understood that all the parts of the handle and the head which are in contact in operational position may present complementary interfitting shapes in order to complete the clamping and/or blocking means provided specifically in each case.

Moreover, without departing from the scope of the invention, springs may be added to the articulation which automatically return the handle and the head in line with each other—or, on the contrary, folded down against each other—in order to simplify the manoeuvre.

What is claimed is:

1. A racket for ball games comprising a handle and a head pivotally attached with respect thereto, said head comprising a frame including two arms extending on either side of the handle and converging into contact therewith, cooperative stop lug and notch means interposed between said head and handle for disposing said head and handle in an aligned position, said handle extending between said arms and having an end portion abutting said frame, locking means interposed between said end portion of said handle and said frame for locking said handle to said frame in said aligned position, a pivot pin linking said arms of said head and said handle, said pivot pin having two axes lying substantially in the plane of said head and offset with respect to each other in the longitudinal direction of said handle, said pin being substantially in the form of an Omega, having a center portion defining a first said axis of said two axes, and having co-axial distal arms defining a second axis of said two axes, said center portion of said pin extending through said handle and said distal arms of said pin extending through said arms of said frame, said racket further comprising vibration dampening means interposed between said handle and said frame.

2. A racket for ball games comprising a handle and a head pivotably attached with respect thereto, said handle comprising two diverging arms extending from a base toward said head and contacting said head at two spaced apart points, said head including a longitudinal extension extending toward said handle and contacting said handle at said base of said arms, locking means interposed between the ends of said arms and said head and between said end of said extension and said handle for securing said head and handle in an aligned position, a pivot pin linking said arms of said handle and said extension of said head, said pivot pin having two axes of rotation lying substantially in the plane of said head and offset with respect to each other in the longitudinal direction of said handle, said pin being substantially in the form of an Omega having a center portion defining a first said axis of said two axes, and coaxial distal arms defining a second said axis of said two axes, said center portion of said pin extending through said extension of said head and said distal arms of said pin extending through said arms of said handle, said racket further comprising vibration damping means interposed between said handle and said frame.

* * * * *